US008580719B2

(12) United States Patent
Ishikawa et al.

(10) Patent No.: US 8,580,719 B2
(45) Date of Patent: Nov. 12, 2013

(54) LUBRICATING OIL COMPOSITION FOR INTERNAL COMBUSTION ENGINE

(75) Inventors: Motoharu Ishikawa, Chiba (JP); Masahiko Kido, Chiba (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 472 days.

(21) Appl. No.: 12/295,103

(22) PCT Filed: Mar. 29, 2007

(86) PCT No.: PCT/JP2007/056885

§ 371 (c)(1), (2), (4) Date: Apr. 7, 2009

(87) PCT Pub. No.: WO2007/114260

PCT Pub. Date: Oct. 11, 2007

(65) Prior Publication Data

US 2009/0312208 A1 Dec. 17, 2009

(30) Foreign Application Priority Data

Mar. 31, 2006 (JP) ..... 2006-100328

(51) Int. Cl.
*C10M 169/04* (2006.01)
*C10M 143/06* (2006.01)

(52) U.S. Cl.
USPC ..... 508/591

(58) Field of Classification Search
USPC ..... 508/591
See application file for complete search history.

(56) References Cited

U.S. PATENT DOCUMENTS

| | | | | |
|---|---|---|---|---|
| 3,853,772 | A * | 12/1974 | Adams | 508/156 |
| 3,855,135 | A * | 12/1974 | Newingham et al. | 508/297 |
| 3,919,098 | A | 11/1975 | Altgelt | |
| 4,948,522 | A * | 8/1990 | Dunn et al. | 508/192 |
| 5,605,880 | A | 2/1997 | Arai et al. | |
| 5,744,430 | A * | 4/1998 | Inoue et al. | 508/295 |
| 6,528,461 | B1 | 3/2003 | Mike et al. | |
| 6,528,694 | B1 | 3/2003 | Chiga | |
| 6,642,189 | B2 | 11/2003 | Kurihara et al. | |
| 2001/0027169 | A1 | 10/2001 | Kurihara et al. | |
| 2003/0162673 | A1 | 8/2003 | Kurihara et al. | |
| 2005/0137097 | A1 * | 6/2005 | George et al. | 508/291 |

FOREIGN PATENT DOCUMENTS

| | | |
|---|---|---|
| EP | 0262977 | 6/1988 |
| EP | 0331359 | 6/1989 |
| EP | 0302239 | 8/1989 |
| EP | 0 562 172 | 9/1993 |
| JP | 61087792 | 6/1986 |
| JP | 63 205395 | 8/1988 |
| JP | 63 205396 | 8/1988 |
| JP | 05 163497 | 6/1993 |
| JP | 06 313183 | 11/1994 |
| JP | 2001 181664 | 7/2001 |
| JP | 2002 012884 | 1/2002 |
| JP | 2002 167592 | 6/2002 |
| JP | 2002 220597 | 8/2002 |
| JP | 2004 010799 | 1/2004 |
| JP | 2005 171186 | 6/2005 |
| JP | 2006 016453 | 1/2006 |

OTHER PUBLICATIONS

European Search Report, Dated: Jul. 2, 2012, in Application No. 07740323.6-2104/2011854 PCT/JP2007056885.

* cited by examiner

*Primary Examiner* — Jim Goloboy
(74) *Attorney, Agent, or Firm* — Oblon, Spivak, McClelland, Maier & Neustadt, L.L.P.

(57) ABSTRACT

A lubricating oil composition for internal combustion engines which comprises a base oil comprising mineral oils and/or synthetic oils and polyisobutylene having a weight-average molecular weight of 500,000 or higher. Consumption of the engine oil can be decreased by using the above composition. In particular, consumption of the engine oil can be decreased even when the above composition is used as the engine oil of the energy saving type using a base oil having a low viscosity.

10 Claims, No Drawings

LUBRICATING OIL COMPOSITION FOR INTERNAL COMBUSTION ENGINE

TECHNICAL FIELD

The present invention relates to a lubricating oil composition for internal combustion engines and, more particularly, to a lubricating oil composition for internal combustion engines exhibiting a decreased consumption of the oil.

BACKGROUND ART

Improvement in the fuel consumption of automobiles is a very important subject for saving energy. This subject is important for human society from the standpoint of decreasing generation of carbon dioxide ($CO_2$) as one of the means for preventing the global warming.

With respect to the lubricating oil for internal combustion engines (the engine oil), it is known that the decrease in the viscosity is effective as the means for decreasing the fuel consumption since friction loss (resistance of stirring) in the engine oil can be decreased. Therefore, it is necessary for improving the fuel consumption of an automobile that viscosity of the base oil constituting the major portion of the engine oil be decreased.

However, when the viscosity of the engine oil is decreased, problems arise in that wear resistance which is essential for the engine oil decreases and that the consumption of the oil increases due to the increase in vaporization of the oil and the increase in the amount of the oil discharged to the outside accompanied with the blow-by gas of the engine. It is the actual situation that decreasing the viscosity of the engine oil (the base oil) is difficult.

To overcome the problem of the decrease in the wear resistance due to the decrease in the viscosity of the base oil among the above problems, the addition of an agent for improving the load carrying property such as an oiliness agent, an anti-wear agent and an extreme pressure agent can be considered. It is proposed that an organomolybdenum compound is added as the friction modifier (for example, refer to Patent References 1 and 2).

To overcome the problem of the increase in the consumption of the oil, the use of a synthetic oil having a low viscosity and a high viscosity index is attempted. However, the synthetic oil is expensive, and the sufficient effect is not always obtained by the use of the synthetic oil having a high viscosity index. When a mineral oil-based base oil having an insufficient viscosity index is used, no effective means for overcoming the problems have been found. Therefore, an engine oil of the mileage-saving-type which can achieve the sufficient decrease in the consumption of the oil even when a widely used base oil having a low viscosity is used, has been desired.

In general, the viscosity of the engine oil is decreased when the engine is working since the engine oil is heated at a high temperature. Therefore, there is the possibility that the lubricating property such as the wear resistance of the engine oil becomes insufficient during the driving when a base oil having a low viscosity is used.

To overcome the above problem, a so-called multi-grade engine oil which comprises a macromolecular compound as the viscosity index improver and suppresses the decrease in the viscosity at high temperatures is used.

However, the multi-grade engine oil described above has a problem in that the viscosity index improver, which is a macromolecular compound, is subjected to a shear stress since the engine oil is subjected to a shear stress in the engine, and suppressing the decrease in the viscosity at high temperatures becomes less effective during the use of the engine oil. Therefore, it is required for the engine oil, in particular, for the engine oil of the energy saving type, that the viscosity at low temperatures be low so that the friction loss at low temperatures is small, that the viscosity at high temperatures be high (which means the decrease in the viscosity be small), and that the shear stability be excellent. These properties are, in general, evaluated based on the CCS viscosity at a low temperature such as −35° C. (JIS K 2010), the kinematic viscosity at 100° C. (JIS K 2283) and the high temperature high shear viscosity (ASTM D 4741), respectively.

[Patent Reference 1] Japanese Patent Application Laid-Open No. Heisei 6(1994)-313183

[Patent Reference 2] Japanese Patent Application Laid-Open No. Heisei 5(1993)-163497

DISCLOSURE OF THE INVENTION

Problems to be Overcome by the Invention

The present invention has an object of providing a lubricating oil composition for internal combustion engines which exhibits a decreased consumption of the composition and, in particular, a decreased consumption of the composition when the composition is used as the engine oil of the energy saving type using a base oil having a low viscosity.

Means for Overcoming the Problems

It was found by the present inventors that the object of the present invention could be achieved with a composition obtained by using polyisobutylene having a specific molecular weight. The present invention has been completed based on the knowledge.

The present invention provides:

1. A lubricating oil composition for internal combustion engines, wherein the lubricating oil composition is obtained by adding polyisobutylene having a weight-average molecular weight of 500,000 or higher to a base oil comprising mineral oils and/or synthetic oils;
2. A lubricating oil composition for internal combustion engines described above in 1, wherein the base oil has a kinematic viscosity of 7 $mm^2/s$ or lower at 100° C.;
3. A lubricating oil composition for internal combustion engines described above in 1, wherein an amount of the polyisobutylene as an amount of a resin component is 0.005 to 1% by mass based on an amount of the composition;
4. A lubricating oil composition for internal combustion engines described above in 1, wherein the lubricating oil composition is obtained by further adding at least one agent selected from polymethacrylates, styrene-isoprene copolymers and ethylene-α-olefin copolymers, each having a weight-average molecular weight of 100,000 to 800,000, as a viscosity index improver;
5. A lubricating oil composition for internal combustion engines described above in 1, wherein the lubricating oil composition is obtained by further adding at least one compound selected from zinc dialkyldithiophosphates and organomolybdenum compounds; and
6. A lubricating oil composition for internal combustion engines described above in 1, wherein the lubricating oil composition has a CCS viscosity of 6,200 mPa·s or lower at −35° C., a kinematic viscosity of 35 $mm^2/s$ or lower at 40° C. and a high temperature high shear viscosity of 1.5 mPa·s or higher at 150° C.

The Effect of the Invention

When the lubricating oil composition for internal combustion engines of the present invention is used, consumption of the engine oil can be decreased even when the lubricating oil composition is used as the engine oil of the energy saving type using a base oil having a low viscosity

THE MOST PREFERRED EMBODIMENT TO CARRY OUT THE INVENTION

In the lubricating oil composition for internal combustion engines of the present invention, polyisobutylene (PIB) having a weight-average molecular weight (Mw) of 500,000 or greater is added to a base oil comprising mineral oils and/or synthetic oils. The effect of remarkably suppressing the consumption of the oil can be exhibited by adding the polyisobutylene having a weight-average molecular weight of 500,000 or greater.

It is preferable that the weight-average molecular weight of the polyisobutylene is 600,000 or greater and more preferably 700,000 or greater. The upper limit of the weight-average molecular weight of the polyisobutylene is not particularly defined. The upper limit of the weight-average molecular weight is, in general, 3,000,000 (or smaller), preferably 2,000,000 and more preferably 1,500,000 from the standpoint of the availability and the shear stability of the polymer.

To obtain the weight-average molecular weight of the polyisobutylene, the measurement in accordance with the gel permeation chromatography is conducted, and the weight-average molecular weight is obtained from the result of the measurement by using a calibration curve prepared by using polystyrene.

The process for producing the polyisobutylene is not particularly limited, and the polyisobutylene prepared in accordance with any desired process may be used. For example, the polyisobutylene can be obtained by polymerization in a boiling ethylene using isobutylene alone or a C4 gas containing isobutylene as the raw material and boron trifluoride or aluminum trichloride as the catalyst. The temperature of the reaction is, in general, about −100 to 70° C.

In the present invention, a single type of the polyisobutylene prepared as described above or a combination of two or more types of the polyisobutylenes prepared as described above and having different molecular weights may be used. It is preferable that the amount of the polyisobutylene as the amount of the resin component is 0.005 to 1% by mass, more preferably 0.01 to 0.5% by mass and most preferably 0.02 to 0.1% by mass based on the amount of the composition. When the amount of the polyisobutylene as the amount of the resin component is 0.005% by mass or greater, the effect of decreasing the consumption of the oil can be exhibited. When the amount of the polyisobutylene as the amount of the resin component is 1% by mass or smaller, the storage stability of the composition can be kept excellent.

In the present invention, a base oil comprising mineral oils and/or synthetic oils is used.

It is preferable that the base oil has a kinematic viscosity of 7 $mm^2/s$ or lower and more preferably 5 $mm^2/s$ or lower at 100° C. When the kinematic viscosity is 7 $mm^2/s$ or lower at 100° C., the object of providing the lubricating oil composition for internal combustion engines exhibiting a decreased consumption of the composition can be easily achieved. It is preferable that the lower limit of the kinematic viscosity is 0.5 $mm^2/s$ (or higher) and more preferably 1 $mm^2/s$ at 100° C. When the kinematic viscosity is 0.5 $mm^2/s$ or higher at 100° C., the increase in vaporization of the oil and the increase in the amount of the oil discharged to the outside accompanied with the blow-by gas of the engine can be suppressed, and the required lubricating properties such as the wear resistance can be surely exhibited.

The base oil in the lubricating oil composition for internal combustion engines of the present invention is not particularly limited as long as the above requirement is satisfied. Mineral oils and/or synthetic oils used for conventional lubricating oils can be used.

Examples of the mineral oil-based base oil include refined oils produced through subjecting a lube oil fraction which has been obtained through distillation of crude oil at ambient pressure or distillation of the residue under reduced pressure, to at least one treatment such as solvent deasphalting, solvent extraction, hydro-cracking, solvent dewaxing, or hydro-refining. The other examples of the mineral oil-based base oil include base oils produced by isomerization of a mineral-based wax or a wax (a gas-to-liquid wax) produced in accordance with the Fischer Tropsch process.

It is preferable that the mineral oil-based base oil has a viscosity index of 90 or higher, more preferably 100 or higher and most preferably 110 or higher. When the viscosity index is 90 or higher, the energy saving can be achieved by decreasing the viscosity of the composition at low temperatures, and the lubricating property can be surely exhibited at high temperatures since the viscosity at high temperatures can be increased.

It is preferable that the content of aromatic components (% $C_A$) in the mineral oil-based base oil is 3 or smaller, more preferably 2 or smaller and most preferably 1 or smaller. It is preferable that the content of sulfur is 100 ppm by mass or smaller and more preferably 50 ppm by mass or smaller. When the content of aromatic components is 3 or smaller and the content of sulfur is 100 ppm by mass or smaller, the oxidation stability of the composition can be kept excellent.

Examples of the synthetic oil-based base oil include polybutene, hydrogenation products of polybutene, poly-α-olefins such as 1-decene oligomers, hydrogenation products of the poly-α-olefins, diesters such as di-2-ethylhexyl adipate and di-2-ethylhexyl sebacate, polyol esters such as trimethylolpropane caprylate and pentaerythritol 2-ethylhexanoate, aromatic synthetic oils such as alkylbenzenes and alkylnaphthalenes, polyalkylene glycols and mixtures of these oils.

In the present invention, the mineral oil-based base oil, the synthetic oil-based base oil or a desired mixture of two or more oils selected from the mineral oil-based base oils and the synthetic oil-based base oils can be used. Examples of the base oil include one or more types of the mineral oil-based base oils, one or more types of the synthetic oil-based base oils and mixed oils of one or more types of the mineral oil-based base oils and one or more types of the synthetic oil-based base oils.

In the present invention, various additives conventionally used for lubricating oils for internal combustion engines can be used in combination with the above components.

Examples of the additive include ashless antioxidants such as alkylaromatic amines and alkylphenols; metallic detergents such as neutral or perbasic sulfonates, phenates, salicylates, carboxylates and phosphonates having an alkaline earth metal, examples of which include Ca, Mg and Ba; ashless dispersants such as succinimides (including boronation products) and esters of succinic acid; antiwear agents and extreme pressure agents such as zinc dialkyldithiophosphates (ZnDTP), organomolybdenum compounds, examples of which include molybdenum dithiocarbamate (MoDTC), molybdenum dithiophosphate (MoDTP) and amine complexes of molybdenum, sulfurized oils and fats, sulfurized olefins, polysulfides, esters of phosphoric acid, esters of phosphorous acid and amine salts of these acids; pour point depressants; rust preventives; and defoaming agents.

In particular, it is preferable that the lubricating oil composition for internal combustion engines of the present invention comprises a zinc dialkyldithiophosphate (ZnDTP) and/or an organomolybdenum compound such as molybdenum dithiocarbamate (MoDTC) so that the wear resistance and the oxidation stability can be provided. The amount of the additives is, in general, 0.05 to 5% by mass and preferably 0.1 to 3% by mass based on the amount of the composition.

The lubricating oil composition for internal combustion engines of the present invention may further comprise a viscosity index improver. Examples of the viscosity index improver include polymethacrylates (PMA), olefin copolymers (OCP), polyalkylstyrenes (PAS) and styrene-diene copolymers (SCP).

It is preferable that, among the above substances, at least one polymer selected from polymethacrylates, styrene-isoprene copolymers and ethylene-α-olefin copolymers, each having a weight-average molecular weight of 100,000 to 800,000 and preferably 150,000 to 600,000, is used. The amount of the viscosity index improver as the amount of the resin component is, in general, 0.01 to 3% by mass and preferably 0.02 to 2% by mass based on the amount of the composition.

Preferable embodiments of the lubricating oil for internal combustion engines of the present invention are shown in the following.

PREFERABLE EMBODIMENTS

A base oil having a kinematic viscosity (100° C.) of 0.5~7 $mm^2/s$:

the rest

PIB having a Mw of 500,000 or greater:

0.005~1% by mass (as the amount of the resin component)

At least one polymer selected from polymethacrylates, styrene-isoprene copolymers and ethylene-α-olefin copolymers, each having a weight-average molecular weight of 100,000 to 800,000:

0.01~3% by mass (as the amount of the resin component)

An alkylaromatic amine and/or an alkylphenol:

0.1~3% by mass

Metallic detergents of an alkaline earth metal comprising at least one compound selected from perbasic sulfonates, phenates and salicylates:

0.5~10% by mass

Succinimide and/or a boronation product thereof:

1~10% by mass

ZnDTP and/or an organomolybdenum compound:

0.05~5% by mass

A pour point depressant:

0~1% by mass

Others (rust preventives, corrosion inhibitors, demulsifiers, defoaming agents and the like):

0~5% by mass

In general, the lubricating oil composition for internal combustion engines of the present invention has the property such that the kinematic viscosity is 20 to 35 $mm^2/s$ at 40° C. and a viscosity index is 120 to 300.

The CCS viscosity is 6,200 mPa·s or lower at −35° C., and the high temperature high shear viscosity (the HTHS viscosity) is 1.5 mPa·s or higher and preferably 1.8 mPa or higher at 150° C.

EXAMPLES

The present invention will be described more specifically with reference to examples in the following. However, the present invention is not limited to the examples. The properties of the lubricating oil composition for internal combustion engines were obtained in accordance with the following methods.

(1) Kinematic Viscosity

The kinematic viscosity was measured in accordance with the method of JIS X 2283.

(2) CCS Viscosity

The CCS viscosity was measured at −35° C. in accordance with the method of JIS K 2010.

(3) High Temperature High Shear Viscosity (HTHS Viscosity)

The viscosity after shearing at a shear rate of $10^6/s$ at 150° C. was measured in accordance with the method of ASTM D 4741.

(4) Measurement of the Amount of the Consumed Oil

The engine test was conducted for 300 hours in accordance with the method of "the test of the cleanness of a lubricating oil for gasoline engines for automobiles" specified in JASO M331-191, and the amount of the oil consumed in the test was obtained in accordance with the following equation:

Amount of consumed oil=the amount of initially supplied oil+the amount of supplemented oil−the amount of oil remaining after the test was completed

Examples 1 and 2 and Comparative Example 1 to 3

Lubricating oil compositions for internal combustion engines were prepared by mixing base oils and additives shown in Table 1 in relative amounts shown in Table 1. The properties, the compositions and the performances of the prepared lubricating oil compositions are shown in Table 1.

TABLE 1

| | Example | | Comparative Example | | |
|---|---|---|---|---|---|
| | 1 | 2 | 1 | 2 | 3 |
| Formulation of composition (% by mass) | | | | | |
| base oil | | | | | |
| base oil 1 [1)] | 85.84 | 60.74 | 87.14 | 86.04 | 83.34 |
| base oil 2 [2)] | — | 25.00 | — | — | — |
| additive | | | | | |
| polyisobutylene [3)] (resin component) | 1.00 (0.049) | 0.60 (0.029) | — | — | — |
| viscosity index improver A [4)] | — | 1.50 | 0.70 | 1.80 | 4.5 |

TABLE 1-continued

| | Example | | Comparative Example | | |
|---|---|---|---|---|---|
| | 1 | 2 | 1 | 2 | 3 |
| (the resin component) | | (0.585) | (0.273) | (0.702) | (1.775) |
| viscosity index improver B [5] | 1.00 | — | — | — | — |
| (the resin component) | (0.065) | | | | |
| ZnDTP [6] | 0.98 | 0.98 | 0.98 | 0.98 | 0.98 |
| MoDTC [7] | 1.60 | 1.60 | 1.60 | 1.60 | 1.60 |
| other additives [8] | 9.58 | 9.58 | 9.58 | 9.58 | 9.58 |
| Properties and performances of the composition | | | | | |
| kinematic viscosity (40° C.) $mm^2/s$ | 33.61 | 31.03 | 30.05 | 32.31 | 38.66 |
| kinematic viscosity (100° C.) $mm^2/s$ | 6.67 | 6.73 | 6.22 | 6.90 | 8.516 |
| viscosity index | 159 | 183 | 163 | 182 | 207 |
| CCS viscosity (−35° C.) mPa · s | 5200 | 4200 | 5100 | 5150 | 5150 |
| high temperature high shear viscosity (150° C.) mPa · s | 2.19 | 2.23 | 2.17 | 2.29 | 2.61 |
| amount of consumed oil g/300 hr | 315 | 450 | 799 | 680 | 463 |

Notes:

[1] A based oil purified by hydrogenation (the kinematic viscosity at 40° C.: 21 $mm^2/s$: the kinematic viscosity at 100° C.: 4.5 $mm^2/s$; the viscosity index: 127; % $C_A$: 0; the content of sulfur: ≤20 ppm by mass)

[2] A base oil purified by hydrogenation (the kinematic viscosity at 40° C.: 12 $mm^2/s$: the kinematic viscosity at 100° C.: 3.0 $mm^2/s$; the viscosity index: 100; % $C_A$: 0.4; the content of sulfur: ≤20 ppm by mass)

[3] Mw: 760,000; the content of the resin component: 4.9% by mass

[4] A polymethacrylate (Mw: 420,000; the content of the resin component 39% by mass)

[5] An ethylene-propylene copolymer (Mw: 280,000; the content of the resin component: 6.5% by mass)

[6] A zinc dialkyldithiophosphate (the content of zinc: 0.11% by mass; the content of phosphorus: 0.10% by mass; the alkyl group: a mixed group composed of secondary butyl group and secondary hexyl group)

[7] Molybdenum dithiocarbamate (the content of molybdenum: 4.5% by mass)

[8] A mixture of the following additives (the amounts based on the amount of the composition)

a polyalkyl methacrylate (Mw: 6,000); 0.30% by mass a mixture of a dialkyldiphenylamine (the content of nitrogen: 4.62% by mass) and a phenol-based antioxidant; 0.80% by mass calcium sulfonate having a base value of 300 mg/KOH; 1.65% by mass a mixture of polybutenylsuccinimide (the content of nitrogen: 0.7% by mass) and polybutenylsuccinimide modified with boron (the content of boron: 2% by mass; the content of nitrogen: 2.1% by mass); 5.0% by mass a mixture of a rust preventive, a corrosion inhibitor, an demulsifier and a defoaming agent; 1.83% by mass It is shown by the results in Table 1 that the compositions of Examples 1 and 2 containing polyisobutylene having a weight-average molecular weight of 760,000 exhibited much smaller amounts of the consumed oil than those of the compositions of Comparative Examples 1 to 3 which did not contain the polyisobutylene. Moreover, even though the compositions of Examples 1 and 2 contained the polyisobutylene having a great molecular weight, the viscosity at a low temperature (the CCS viscosity) and the high temperature high shear viscosity of the compositions of Examples 1 and 2 were about the same or lower than those of the compositions of Comparative Examples 1 to 3 which did not contain the macromolecular compound. The composition of Comparative Example 3 which contained a great amount (about 1.8% by mass as the amount of the resin component) of the polymethacrylate having a weight-average molecular weight of 420,000 exhibited a greater amount of consumed oil than the amounts exhibited in Examples 1 and 2. Moreover, the kinematic viscosity at 40° C. was about 38.7 $mm^2/s$, and the kinematic viscosity at 100° C. was about 8.5 $mm^2/s$, both being considerably higher values than those in Examples 1 and 2. Therefore, the property of saving fuel in Comparative Example 3 was inferior to those in Examples 1 and 2.

INDUSTRIAL APPLICABILITY

The lubricating oil composition for internal combustion engines of the present invention can decrease the consumption of the oil even when the oil composition is used as the engine oil of the energy saving type using a base oil having a low viscosity. Therefore, the lubricating oil composition exhibits the property for saving the resources and the fuel and can be advantageously used as the lubricating oil composition for internal combustion engines which can contribute to overcoming the problem of the global warming.

The invention claimed is:

1. A lubricating oil composition comprising:

a base oil comprising at least one oil selected from the group consisting of a mineral oil, a synthetic oil, and a mixture thereof;

0.029-0.049 wt. % of polyisobutylene, based on an amount of a resin component in the lubricating oil composition, wherein the polyisobutylene has a weight-average molecular weight of 500,000 or higher; and 0.065-0.585 wt. % of a viscosity index improver, based on an amount of a resin component in the lubricating oil composition, wherein the viscosity index improver comprises at least one polymer selected from the group consisting of a polymethacrylate, a styrene-isoprene copolymer, and an ethylene-α-olefin copolymer, and wherein the polymer has a weight-average molecular weight of 100,000-800,000, wherein the lubricating oil composition has a kinematic viscosity of 35 $mm^2/s$ or lower at 40° C. and a viscosity index of 120-300.

2. The lubricating oil composition according to claim 1, wherein the base oil has a kinematic viscosity of 7 $mm^2/s$ or lower at 100° C.

3. The lubricating oil composition according to claim 1, wherein the lubricating oil composition further comprises:

at least one compound selected from the group consisting of a zinc dialkyldithiophosphate compound and an organomolybdenum compound.

4. The lubricating oil composition according to claim 1, wherein the lubricating oil composition has a CCS viscosity of 6,200 mPa·s or lower at −35° C., and a high temperature high shear viscosity of 1.5 mPa·s or higher at 150° C.

5. A lubricating oil composition comprising:

a base oil comprising at least one oil selected from the group consisting of a mineral oil, a synthetic oil, and a mixture thereof, wherein the base oil has a kinematic viscosity of 7 $mm^2/s$ or lower at 100° C.;

0.029-0.049 wt. % of polyisobutylene, based on an amount of a resin component in the lubricating oil composition, wherein the polyisobutylene has a weight-average molecular weight of 500,000 or higher;

0.065-0.585 wt. % of a viscosity improver, based on an amount of a resin component in the lubricating oil composition wherein the viscosity improver comprises at least one polymer selected from the group consisting of a polymethacrylate, a styrene-isoprene copolymer, and an ethylene-α-olefin copolymer, wherein the polymer has a weight-average molecular weight of 100,000-800,000;

0.1-3 wt. % of an ashless antioxidant, based on a total weight of the lubricating oil composition, wherein the ashless antioxidant is selected from the group consisting of an alkylaromatic amine, an alkylphenol, and a mixture thereof;

0.5-10 wt. % of a metallic detergent, based on a total weight of the lubricating oil composition, wherein the metallic detergent comprises an alkaline earth metal and at least one perbasic compound selected from the group consisting of a sulfonate, a phenate, a salicylate, and a mixture thereof;

1-10 wt. % of an ashless dispersant, based on a total weight of the lubricating oil composition, wherein the ashless dispersant is selected from the group consisting of a succinimide compound, a boronated succinimide compound, and a mixture thereof;

0.05-5 wt. % of an antiwear agent, based on a total weight of the lubricating oil composition, wherein the antiwear agent is selected from the group consisting of a zinc dialkyldithiophosphate compound, an organomolybdenum compound, and a mixture thereof; and 0.1-5 wt. % of an additive selected from the group consisting of a pour point depressant, a rust preventive, a corrosion inhibitor, a demulsifier, a defoaming agent, and a mixture thereof, wherein the lubricating oil composition has a CCS viscosity of 6,200 mPa·s or lower at −35° C., a kinematic viscosity of 35 $mm^2/s$ or lower at 40° C., a high temperature high shear viscosity of 1.5 mPa·s or higher at 150° C., and a viscosity index of 120-300.

6. The lubricating oil composition of claim 1, further comprising:

0.1-3 wt. % of an ashless antioxidant, based on a total weight of the lubricating oil composition, wherein the ashless antioxidant is at least one selected from the group consisting of an alkylaromatic amine and an alkylphenol.

7. The lubricating oil composition of claim 1, further comprising:

0.5-10 wt. % of a metallic detergent, based on a total weight of the lubricating oil composition, wherein the metallic detergent comprises an alkaline earth metal and at least one perbasic compound selected from the group consisting of a sulfonate, a phenate, and a salicylate.

8. The lubricating oil composition of claim 1, further comprising:

1-10 wt. % of an ashless dispersant, based on a total weight of the lubricating oil composition, wherein the ashless dispersant is at least one selected from the group consisting of a succinimide compound and a boronated succinimide compound.

9. The lubricating oil composition of claim 1, further comprising:

0.05-5 wt. % of an antiwear agent, based on a total weight of the lubricating oil composition, wherein the antiwear agent is at least one selected from the group consisting of a zinc dialkyldithiophosphate compound and an organomolybdenum compound.

10. The lubricating oil composition of claim 1, wherein the composition is prepared by adding to the base oil:

a polyisobutylene-containing additive in an amount of 0.60 to 1.00 wt. %, based on a total weight of the lubricating oil composition, and a viscosity index improver-containing additive in an amount of 1.00 to 1.50 wt. %, based on a total weight of the lubricating oil composition.

* * * * *